United States Patent [19]

Michaud et al.

[11] Patent Number: 4,838,381

[45] Date of Patent: Jun. 13, 1989

[54] ARTICULATED BOOM JIB ASSEMBLY

[75] Inventors: Paul Michaud; Jean T. Bédard; Bertrand Poudrier, all of Québec, Canada

[73] Assignee: Posi-Plus Technologies Inc., Quebec, Canada

[21] Appl. No.: 172,804

[22] Filed: Mar. 28, 1988

[30] Foreign Application Priority Data

Mar. 17, 1988 [CA] Canada ..... 561719

[51] Int. Cl.[4] ..... B66F 11/04

[52] U.S. Cl. ..... 182/2; 212/266

[58] Field of Search ..... 182/2; 52/116, 118; 212/266

[56] References Cited

U.S. PATENT DOCUMENTS

| | | | |
|---|---|---|---|
| 3,146,853 | 9/1964 | Eckels | 182/2 |
| 3,474,922 | 2/1969 | Wood et al. . | |
| 4,466,506 | 8/1984 | Dolenti | 182/2 |
| 4,533,119 | 8/1985 | Liverance et al. . | |
| 4,582,206 | 4/1986 | Johnson | 182/2 |

FOREIGN PATENT DOCUMENTS 1198691 12/1985 Canada .

*Primary Examiner*—Reinaldo P. Machado

*Attorney, Agent, or Firm*—Oblon, Spivak, McClelland, Maier & Neustadt

[57] ABSTRACT

A jib assembly displaceably attached to an articulated boom comprising an elongated jib member having an attachment sleeve element secured thereto. A planetary gear reducer having a driving element, is coupled to a gear train and securable inside the boom. The gear train has an output drive gear protruding adjacent a side wall of the boom. A drive gear coupling element is secured to the jib attachment sleeve and in toothed engagement with the output drive gear for rotatably connecting the sleeve element closely spaced to the boom side wall to reduce stress on the gear coupling caused by the load associated with the jib assembly. Also, stress is reduced on the bucket support shaft associated with said boom by providing a closer spacing of the bucket to the boom.

10 Claims, 3 Drawing Sheets

ARTICULATED BOOM JIB ASSEMBLY

BACKGROUND OF INVENTION (a) Field of the Invention

The present invention relates to an improved jib assembly including a planetary gear reducer for the rotation of the assembly and for connecting same to an articulated boom.

(b) Description of Prior Art

A jib assembly generally of the type disclosed herein is described in Canadian Pat. No. 1,198,691 issued Dec. 31, 1985. The jib assembly as described in that prior art patent has disadvantages which the present invention overcomes. One main disadvantage of the prior art jib construction is that the jib is supported far from the boom thereby requiring a longer bucket support shaft as the jib is interposed between the bucket and the boom. Such long support shaft is subjected to heavier stresses due to its length. If two buckets are mounted on opposed sides of the same articulated boom, then one of the work persons is far, this away from the jib and to the increased spacing. A jib is usually used as boom for supporting or lifting heavy objects and is manipulated by a work person(s) occupying the bucket or buckets. The jib rotation drive disclosed in this patent is a worm gear arrangement using very high gear ratios, greater than 15:1, and thus adds to the considerable size and weight of the coupling. Also, the gear reduction unit is located outside the articulated boom and could be hazardous when located close to electrical transmission lines.

SUMMARY OF INVENTION

It is a feature of the present invention to provide an improved jib assembly which substantially overcomes the above-mentioned disadvantages of the prior art.

Another feature of the present invention is to provide an improved jib assembly using a planetary gear train mounted inside the boom whereby the jib assembly can be located immediately adjacent the boom thereby reducing stresses on the gear coupling and the bucket support shaft.

Another feature of the present invention is to provide an improved jib assembly which provides added safety.

Another feature of the present invention is to provide an improved jib assembly which permits the jib to be rotated a full continuous 360° by the use of a planetary gear reducer and wherein the gear reducer increases the torque from the drive motor and gives the jib greater leverage to lift or move a weight.

According to the above features, from a broad aspect, the present invention provides a jib assembly displaceably attached to a boom. The jib assembly comprises an elongated jib member having an attachment sleeve element secured thereto. A planetary gear reducer having a driving element is coupled to a gear train and securable inside the boom. The gear train has an output drive gear protruding adjacent a side wall of the boom. A drive gear coupling element is secured to the jib attachment sleeve and is in toothed engagement with the output drive gear for rotatably connecting the sleeve element closely spaced to the boom side wall to reduce stress on the gear coupling caused by the load associated with the jib assembly and also to reduce stress on a bucket support shaft associated with the boom by providing a closer spacing of the bucket to the boom.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
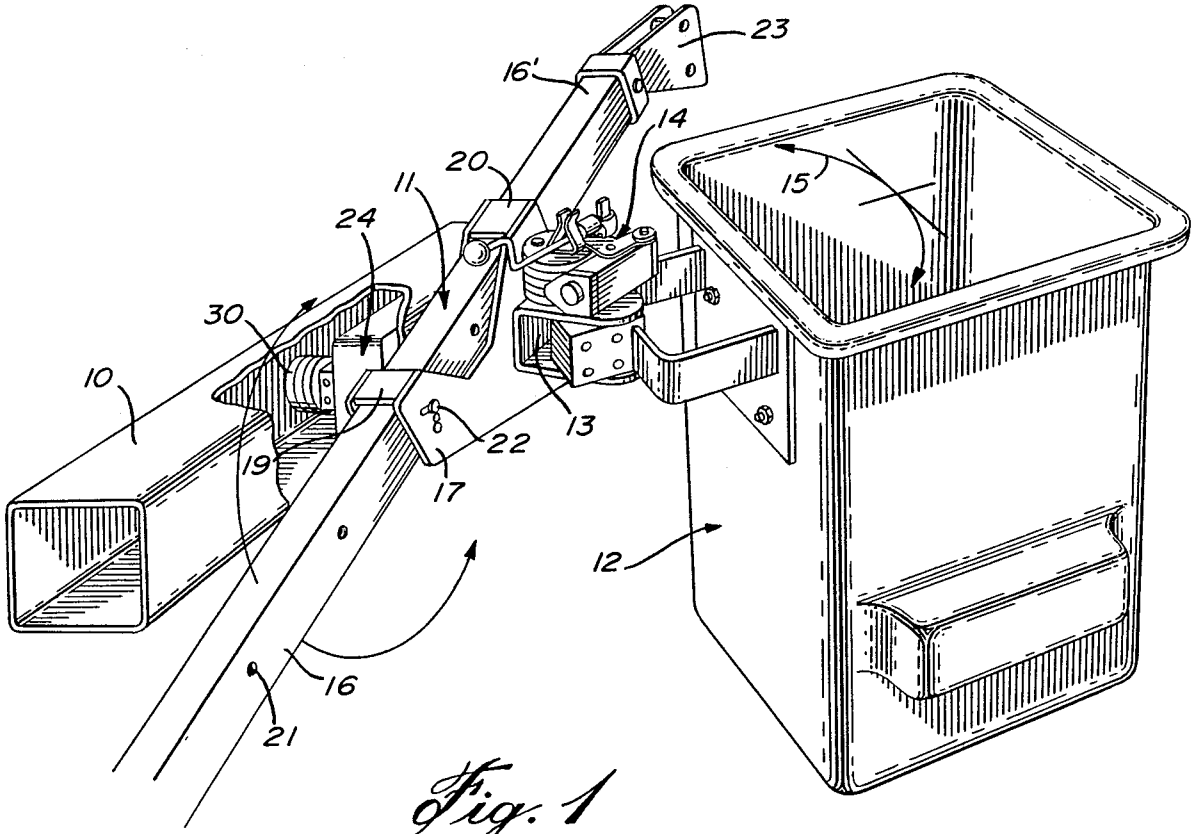
FIG. 1 is a perspective view of an articulated boom supporting a bucket and having the jib assembly of the present invention secured thereto.

Referring to the drawings, and more particularly to FIG. 1, there is shown an articulated boom section 10 usually connected to a vehicle (not shown) and having a jib assembly 11 secured adjacent a free end the boom. A bucket 12 is secured to a shaft coupling 13 which is freely axially rotatable with respect to the boom 10. A bucket rotation drive system 14 is secured to the coupling 13 for displacing the bucket along the direction of the arc 15, and does not form part of this invention.

Figure 2:
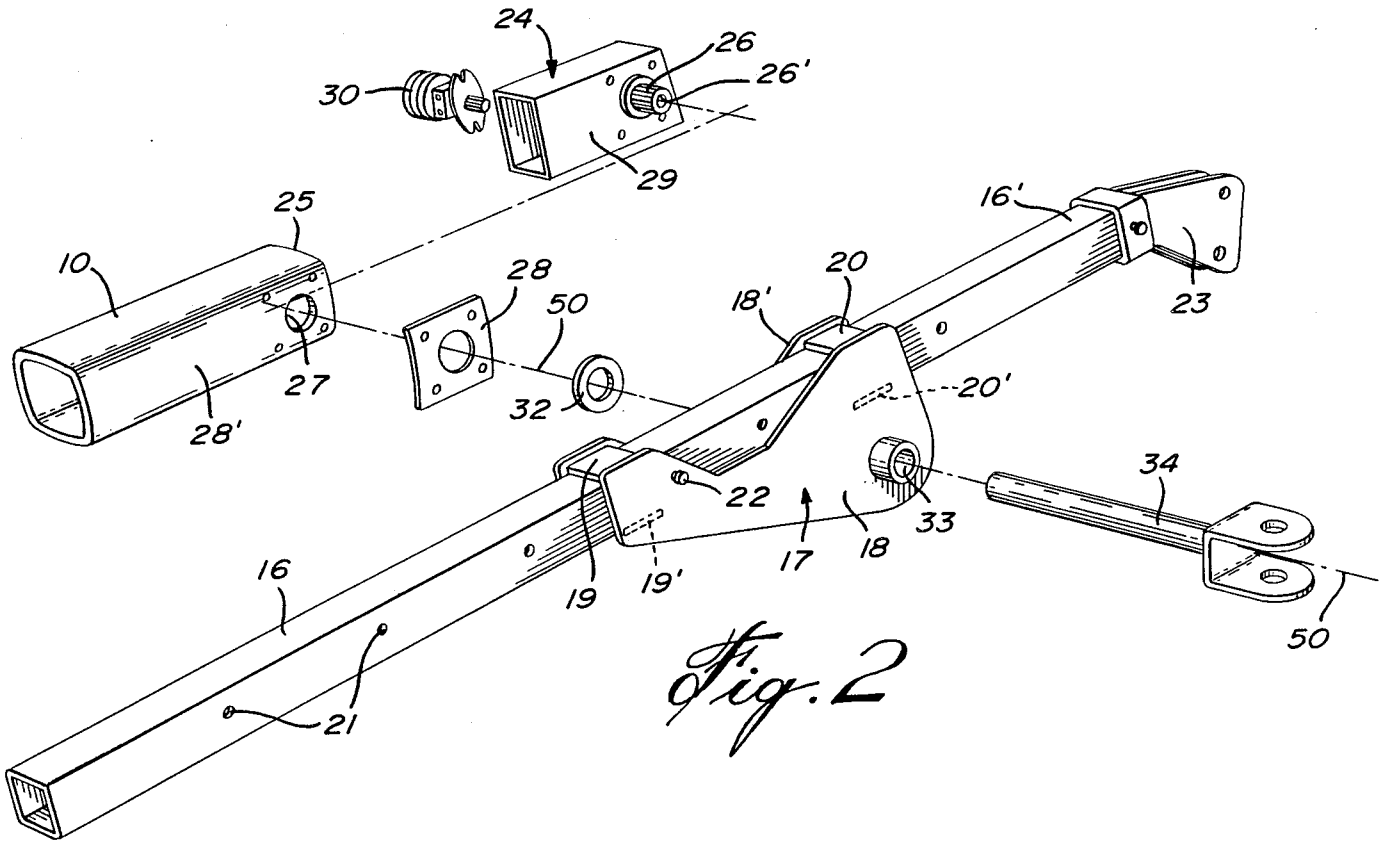
FIG. 2 is an exploded view of the improved jib assembly of the present invention.

Referring now additionally to FIG. 2, the jib assembly 11 is herein shown as comprising an elongated auxiliary boom or jib member 16 having an attachment sleeve element 17 secured thereto.

As shown more clearly in FIG. 2, the jib attachment sleeve 17 is comprised of two opposed parallel metal plates 18 and 18' having opposed transverse spacing walls or brackets 19, 19' and 20, 20' spaced apart to define a channel therebetween through which the jib 16 extends. As herein shown, the jib is of substantially rectangular cross section and is provided with holes 21 equidistantly spaced apart in a side wall thereof. A lock pin 22 is secured in the outer side wall 18 of the sleeve element and interlocks the sleeve with the jib so that the working end 16' of the jib may have a desired extension. A pulley support bracket 23 is secured at the free end 16' of the jib and is used for lifting or supporting loads. Thus, the jib 16 is displaceably secured to the sleeve element.

The jib assembly 11 further comprises a planetary gear reducer 24 which is securable in a hollow end portion 25 of the boom 10 and is provided with an output drive gear 26 which extends into a hole 27 provided in a side wall 28' of the boom 10. A reinforcing plate 28 is secured over the outer surface of the side wall 28' of the boom to reinforce the boom in its connected portion with the housing 29 of the gear reducer 24. A hydraulic motor 30 provides the drive for a gear train 31 (see FIG. 3) located within the gear box 29.

A drive gear coupling element 32, in the form of a splined bushing, is secured to the inner side wall 18' of the jib attachment sleeve 17 about a hole (not shown) but in alignment with the hole 33 provided in the outside plate 18 for the passage of a bucket support shaft 34 therethrough. The bucket support shaft extends through the hole 33, the spline bushing 32, the plate 28, the hole 26' in the output drive gear 26 and the gear box 24 and secured across the boom 10 and freely axially rotatable therein so that when the articulated boom 10 is displaced, the bucket 12 is maintained in the horizontal plane.

With this planetary gear reducing coupling, it can be seen from FIG. 1, that the attachment sleeve element 17 and the jib 16, can be secured immediately adjacent the boom 10. Thus, there is reduced stress on the gear coupling between the attachment sleeve element 17 as the spacing is maintained at a minimum and thus there is no need for long gears having to support heavy loads. Furthermore, the bucket support shaft 34 can be made shorter and is provided with more transverse support between the boom and the sleeve element 17 thereby greatly reducing stress, on this shaft imparted by the load of the bucket 12 and the person in the bucket or any additional equipment that can be carried by the bucket and also of the jib assembly through which the shaft protrudes. If the jib is used to lift a heavy load, this is also transferred to the bucket connecting shaft 34 through the sleeve element 17.

Figure 3:
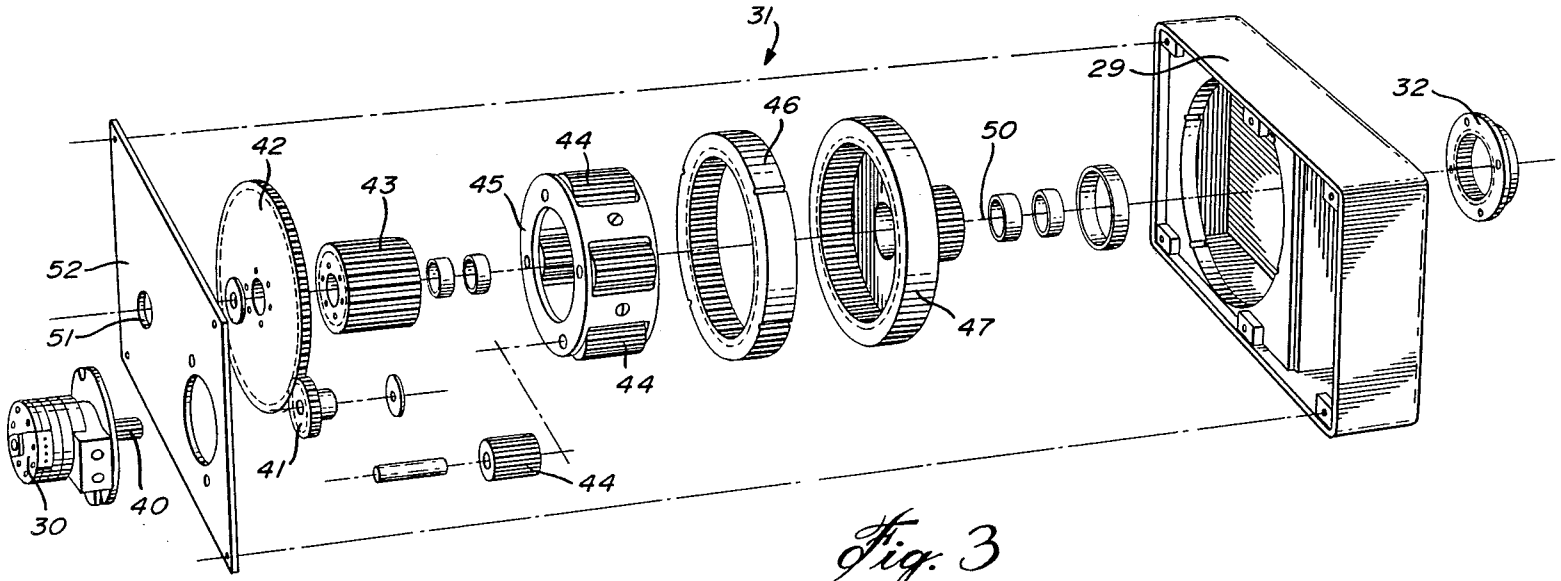
FIG. 3 is an exploded view of the planetary gear reducer.
Figure 2:
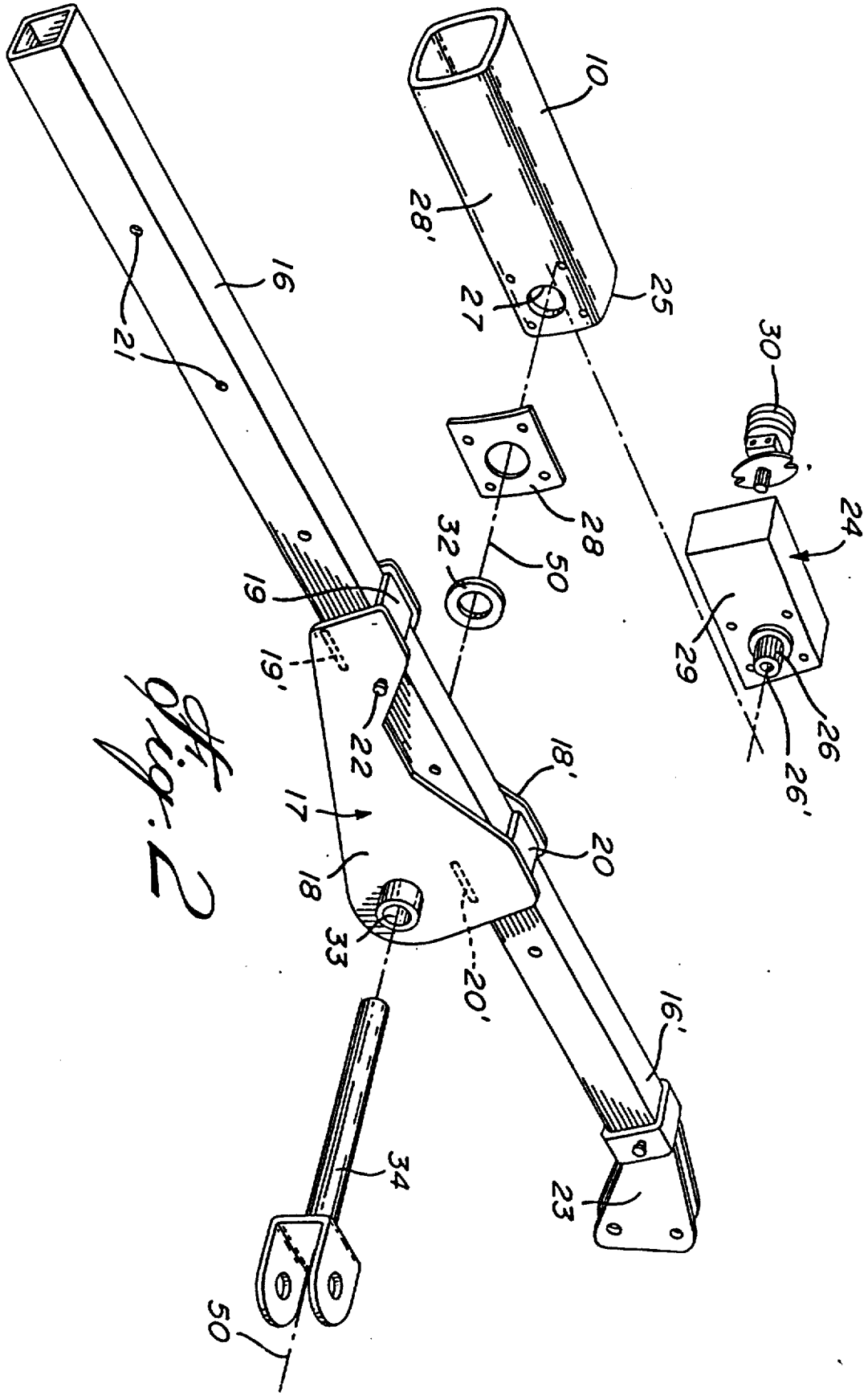

Referring now additionally to FIG. 3, there is shown the construction of the planetary gear reducer. As herein shown, the pinion 40 of the hydraulic motor is fixed to a spur gear 41 having thirty-eight teeth and constituting the driver gear. This spur gear 41 is in toothed engagement with a driven gear 42 having eighty-eight teeth. Thus, the speed reduction is of the order of 2.315:1. A sun gear 43 is secured or bolted to the driven gear 42 and meshes with four planetary gears 44 which are rotatably secured in a planet carrier ring 45 which in turn meshes with a fixed internal gear 46 and a driven internal ring gear 47. The driven internal ring gear 47 is then fitted on the spline bushing 32 which is secured to the inner parallel plate 18' of the attachment sleeve element 17. The fixed internal ring gear 46 has sixty-four teeth while the output internal gear 47 has sixty teeth. Accordingly, for every revolution of the sun gear 43, the jib would turn through an arc of eight degrees (8°). This provides a gear reduction between the sun gear 43 and the attachment sleeve element of 45:1. The total reduction is then of 104.175:1.

Because the driven internal ring gear 47 has four less teeth than the fixed internal gear 46, the teeth will not be aligned with one another. When the gear teeth of the internal ring gears are approximately matched at one point, the teeth will match again at the location of the next planetary gear which is ninety degrees from that point. Along the circumference of the internal ring gears, it is understood that the teeth will match at every ninety degrees.

As can be seen, all of the gears 42, 43, 44, 46 and 47 provide passage along the central axis 50 for the bucket support shaft 34. A hole 51 is also provided in the back plate 52 of the gear box 29 for the passage of this shaft. It is pointed out that these booms are usually constructed of fiberglass and it is preferable that the bucket support shaft extends across the boom for a stronger support thereof.

In operation, as the hydraulic motor 30 turns, the driver gear 41 turns the driven gear 42 with some reduction being achieved. The sun gear 43 is bolted to the driven gear 42 and is in meshing engagement with the planetary gears 44. When the sun gear 43 rotates, the planetary gears 44, also in meshing engagement with the fixed internal ring gear 46, are turning and moving through an arcuate path of travel. This last motion will cause the planet carrier 45 to turn relative to planetary gears. At the same time, the planetary gears 44 mesh with the driven internal ring gear 47 which, due to the difference in number of teeth with respect to the fixed ring gear 46, turns through an arc depending upon the center-to-center spacing of the gear teeth of the driven internal ring gear 47. Accordingly, for every fifteen revolutions of the planet carrier, 45 that is sixty teeth of the driven internal ring gear divided by the difference in number of teeth which is four (sixty-four minus sixty), the driven internal ring gear 47 will turn one revolution thereby rotating the jib attachment sleeve element 17 and displacing the jib. The jib can therefore be completely rotated about a 360° arc.

It is within the ambit of the present invention to cover any obvious modifications of the preferred example described herein, provided such modifications fall within the scope of the appended claims. For example, the gear train may have a different reduction ratio, for example, 100:1 or more or less. It is also pointed out that a reduction ratio which is increased would allow the use of a smaller hydraulic motor. This may be desirable depending on the construction of the articulated boom and the restricted space therein.

We claim:

1. A jib assembly displaceably attached to a boom, said jib assembly comprising an elongated jib member having an attachment sleeve secured thereto, a planetary gear reducer having a driving element coupled to a gear train and securable inside said boom, said gear train having an output drive gear protruding adjacent a side wall of said boom, a drive gear coupling element secured to said attachment sleeve and in toothed engagement with said output drive gear for rotatably connecting said attachment sleeve closely spaced to said boom side wall to reduce stress on the gear coupling caused by the load associated with said jib assembly and also to reduce stress on a bucket support shaft also associated with said boom by providing a closer spacing of said bucket to said boom.

2. A jib assembly as claimed in claim 1 wherein said drive gear coupling element is an annular splined bushing having a toothed ring in engagement with said output drive gear, said drive gear being a ring gear having a circumferential toothed wall and a hollow interior.

3. A jib assembly as claimed in claim 2 wherein said bucket support shaft extends through said attachment sleeve, said annular splined bushing, said drive gear, said planetary gear reducer and said boom; said support shaft being axially and freely rotatable with respect to said boom for maintaining a bucket secured thereto substantially horizontal during articulated displacement of said boom or said jib assembly.

4. A jib assembly as claimed in claim 3 wherein said attachment sleeve defines a channel through which said elongated jib member is disposed, and means for displaceably securing said member to said sleeve element.

5. A jib assembly as claimed in claim 4 wherein said jub member is in auxiliary boom of rectangular cross-section, said sleeve element having two opposed parallel plates with opposed transverse spacing walls secured thereto and forming therebetween a rectangular channel for the passage of said auxiliary boom, said means for displaceably securing said jib being constituted by spaced-apart holes in said auxiliary boom, an outside one of said parallel plates having a lock pin for arresting said auxiliary boom at a desired location with respect to said rectangular channel, said parallel plates having aligned through bores therein for the passage of a bucket support shaft.

6. A jib assembly as claimed in claim 1 wherein said planetary gear reducer gear train is located in a gear box, said driving element being a hydraulic motor secured to said gear box and having a toothed drive shaft in engagement with a driver gear of said gear train, said gear box being secured inside said boom with said output drive gear extending through a hole in a side wall of said boom.

7. A jib assembly as claimed in claim 6 wherein a reinforcing plate is secured about said hole in said boom side wall to reinforce said boom in the area of said gear box, said gear box being bolted to said boom side wall through said plate.

8. A jib assembly as claimed in claim 6 wherein said planetary gear reducer being capable of rotating said jib assembly a full continuous 360° with respect to said boom.

9. A jib assembly as claimed in claim 6 wherein said driver gear is in toothed driving engagement with a large driven gear, a sun gear secured to said driven gear and in meshing engagement with planetary gears secured in a planet carrier desposed about said sun gear, said planetary gears also being in meshing engagement with a fixed internal ring gear and an output internal ring gear, said output internal ring gear having said output drive gear secured thereto.

10. A jib assembly as claimed in claim 9 wherein said bucket support shaft extends, through said attachment sleeve, said annular splined bushing, said drive gear, said planetary gear reducer and said boom; said support shaft being axially and freely rotatable with respect to said boom for maintaining a bucket secured thereto substantially horizontal during articulated displacement of said boom or said jib assembly.

* * * * *

UNITED STATES PATENT AND TRADEMARK OFFICE

CERTIFICATE OF CORRECTION

PATENT NO. : 4,838,381

DATED : June 13, 1989

INVENTOR(S) : Paul Michaud et al

It is certified that error appears in the above-identified patent and that said Letters Patent is hereby corrected as shown below:

Fig. 2 should be deleted to be replaced with Fig. 2 as shown on the attached sheet.

Column 3, line 68, "carrier, 45" should read --carrier 45,--.

Column 4" line 51, "Jub" should read --Jib--.

Column 6, line "desposed" should read --disposed--.

Signed and Sealed this

Twenty-seventh Day of March, 1990

*Attest:*

JEFFREY M. SAMUELS

*Attesting Officer*

*Acting Commissioner of Patents and Trademarks*